US006893619B1

(12) United States Patent
James et al.

(10) Patent No.: US 6,893,619 B1
(45) Date of Patent: May 17, 2005

(54) PLATE-FRAME HEAT EXCHANGE REACTOR WITH SERIAL CROSS-FLOW GEOMETRY

(75) Inventors: Brian David James, Alexandria, VA (US); Franklin Delano Lomax, Alexandria, VA (US); George Newell Baum, Potomac, MD (US)

(73) Assignee: Ford Global Technologies, LLC, Dearborn, MI (US)

( * ) Notice: Subject to any disclaimer, the term of this patent is extended or adjusted under 35 U.S.C. 154(b) by 732 days.

(21) Appl. No.: 09/661,516

(22) Filed: Sep. 13, 2000

(51) Int. Cl.[7] ..... B01J 8/02

(52) U.S. Cl. ..... 422/198; 422/188; 422/189; 422/190; 48/61; 165/166

(58) Field of Search ..... 422/198, 190, 422/191, 196, 211, 188, 189; 165/DIG. 356, 164–167; 429/19; 48/61

(56) References Cited

U.S. PATENT DOCUMENTS 4,829,655 A * 5/1989 Cornelison et al. ..... 29/527.4

FOREIGN PATENT DOCUMENTS

JP 06-111838 * 4/1994 ..... H01M/8/02

* cited by examiner

*Primary Examiner*—Hien Tran
*Assistant Examiner*—Jennifer Leung
(74) *Attorney, Agent, or Firm*—Damian Porcari

(57) ABSTRACT

A plate-frame heat exchange reactor having a serial cross-flow geometry. This is accomplished by designing a plate-frame heat exchanger wherein the flow of feed gas in one cell of the reactor flows perpendicular to the flow of burner exhaust within the next adjacent cell. The improved reactor increases the Reynold's number of the flows as compared with a massively parallel design to improve heat transfer and reactant mixing characteristics, thereby reducing reactor size by half or more. The serial cross-flow arrangement allows for constructing reactors where feed gas addition is possible at many distinct points along the serial flow in order to control hot spots or other undesirable chemical reactions. The new arrangement also greatly reduces manifolding of the flows and reduces the distinct components of the reactor.

6 Claims, 4 Drawing Sheets

PLATE-FRAME HEAT EXCHANGE REACTOR WITH SERIAL CROSS-FLOW GEOMETRY

TECHNICAL FIELD

The present invention relates generally to heat exchange systems and more particularly plate-frame heat exchangers.

BACKGROUND

Plate-frame heat exchangers are commonly employed to provide relatively compact devices with low-pressure drop. Such devices are typically deployed in weight/volume critical applications such as automotive air-conditioning evaporators, gas turbine recuperators, fuel cells, and liquid—liquid industrial heat exchangers. Because these applications are sensitive to both heat exchanger size and pressure drop through the fluid passages, typical plate-frame heat exchangers have a series of individual heat exchanger cells arrayed substantially in parallel (i.e. each cell (hot fluid side and cold fluid side) has the same temperature distribution as every other cell in the stack of cells comprising a completed heat exchanger)).

Because of the success of the plate-frame approach to heat exchange design, it has been widely adapted to chemical reactions requiring temperature control, especially those that require close temperature control because of product selectivity or are strongly endothermic or exothermic and require rapid heating and cooling.

A common example of considerable importance is steam reforming of hydrocarbons and alcohols (This reaction involves the reversible chemical conversion of methane and water into carbon monoxide and hydrogen). This reaction is highly endothermic, and typically requires large amounts of catalyst to promote the reaction. A compilation of the use of the plate-frame reactors is that the effectiveness in exchanging heat between the cooler reformate stream and the hot combustion products plays a strong role in determining the thermal or thermodynamic efficiency of the reforming system. Effectiveness factor is defined as the temperature that occurs in the fluid undergoing the maximum temperature change divided by the difference between the highest and lowest temperatures in the heat exchanger.

Current technologies have focused on plate-frame reformers having an array of small reactors massively in parallel to each other. This design is far more compact, lighter and less expensive than tubular-type reformers which are common in the industry. However, such reformers have three major drawbacks.

First, massively parallel construction leads to low flow velocity (and corresponding Reynolds number) and low laminar flow. This drawback is critical because lower laminar flow reduces heat transfer rates and reduces reactant mixing in the reactor structures, which along with the Reynolds number are factors in sizing the reformer. Hence, a lower Reynolds number requires a larger reformer, which adds to the cost of the reformer system.

Second, manifolding in the massively parallel construction may be fairly complex. This complexity may cause poor fluid distribution with "dead zones", where little flow occurs, which reduces heat exchange effectiveness.

Third, controlled internal release of any one reactant is very difficult as the short reaction zone is only accessible from either end of the plate. This point is particularly important if the heat exchanger structure is to be used as a catalytic burner. Catalytic burning on the heat exchanger walls improves heat transfer locally by obviating convective heat transfer from the gas phase to the wall because the catalysts are located on the wall itself. Unfortunately, if fuel or oxidant levels are not controlled, the catalytic burning can occur at too high a rate, causing local increases in metal temperature referred to as hot spots. Hot spots significantly weaken the structure and may cause mechanical failure. Because of this fact, systems with catalytic burning on the wall must use exotic materials and dilute combustion gases to lower temperatures to an acceptable level, which negatively impacts both cost and efficiency.

It is thus highly desirable to design a plate-frame reactor that combats the three critical drawbacks of the massively parallel system.

SUMMARY OF THE INVENTION

It is thus one object to create a novel method of arranging the elements of a plate-frame heat exchange reactor with serial cross-flow geometry.

The new arrangement has several advantages over the massively parallel reactor systems. First, the new arrangement increases the Reynold's number of the flows to greatly improve the heat transfer characteristics and reactant mixing characteristics of the reactor, thereby reducing the reactor size by half or more. Second, the new arrangement allows for constructing reactors where reactant addition is possible at many distributed points along the serial flow using simple mechanical features in order to control hot spots or other undesirable chemical reactions. Third, the new arrangement greatly simplifies manifolding of the flows and reduces the number of distinct components required in the heat exchanger. Fourth, the heat exchanger plate geometry is not constrained to long narrow ducts to create high aspect ratio counterflow designs.

Other objects and advantages of the present invention will become apparent upon considering the following detailed description and appended claims, and upon reference to the accompanying drawings.

DESCRIPTION OF THE PREFERRED EMBODIMENT(S)

Figure 1:
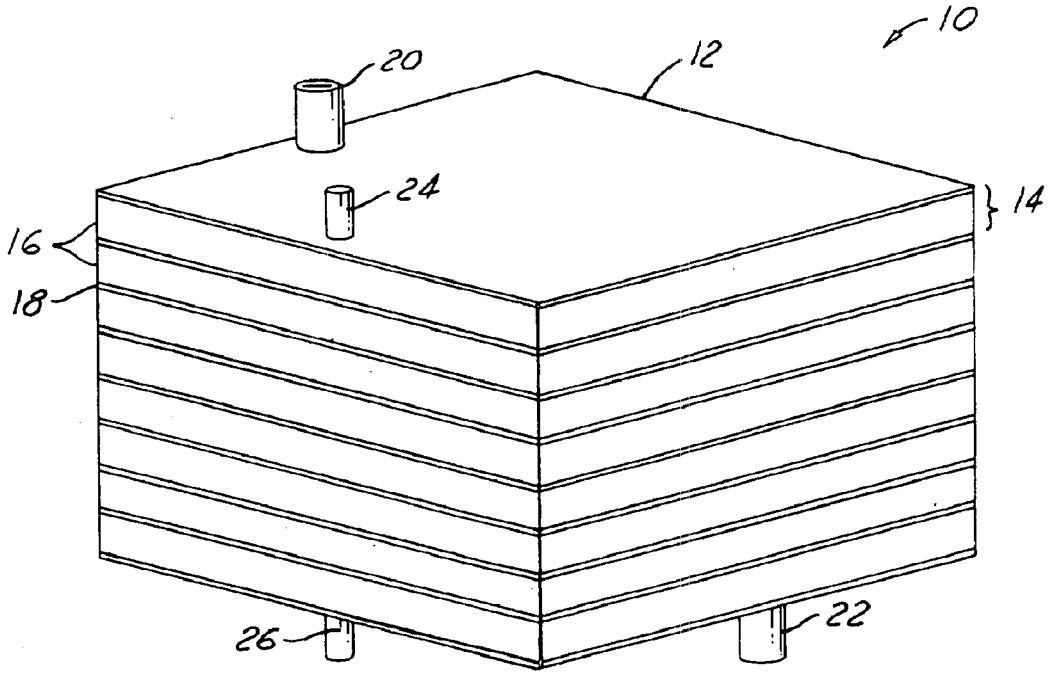
FIG. 1 is a perspective view of a fuel processing assembly with a plate-frame heat exchange reformer having serial cross flow geometry according to the present invention.

Referring now to FIG. 1, a fuel processing assembly 10 which forms a portion of a typical fuel cell power plant is depicted. The assembly 10 includes a plate frame heat exchange reformer 12 for converting hydrocarbon fuels into hydrogen that is used by electrochemical fuel cells (not shown) to generate electricity. The reformer 12 is primarily comprised of a series of stacked cells 14. Each stacked cell 14 is comprised of a header sheet 16 and an interleaved sheet 18. The reformer 12 has an intake port 20 for receiving feed gas, typically gasoline, natural gas, or some other type of hydrocarbon, from a reservoir (not shown) and an outlet port 22 for removing the heated reformed feed gas from the reformer 12. The feed gas may also comprise any combination of water, oxygen, nitrogen, carbon monoxide, carbon dioxide, hydrogen, and partially reacted fuel. The reformer 12 has a burner inlet port 24 for receiving heated burner exhaust gas and/or a partially or wholly unreacted mixture of fuel and oxidant (hereinafter referred to as burner exhaust gas) and a burner outlet port 26 for removing cooled burner exhaust gas from the reformer 12. The flows of the feed gas and burner exhaust through the embodiments of the present invention are described in more detail below.

Figure 2A:
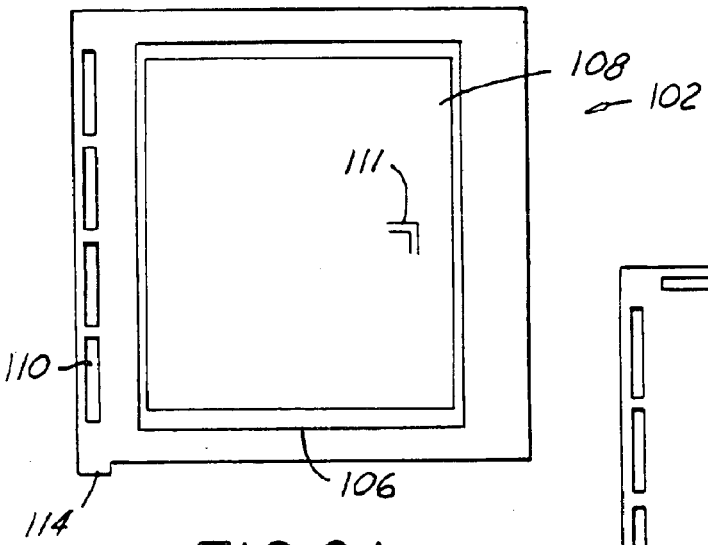
FIG. 2A is a header sheet for use in a preferred embodiment of the present invention.
Figure 3:
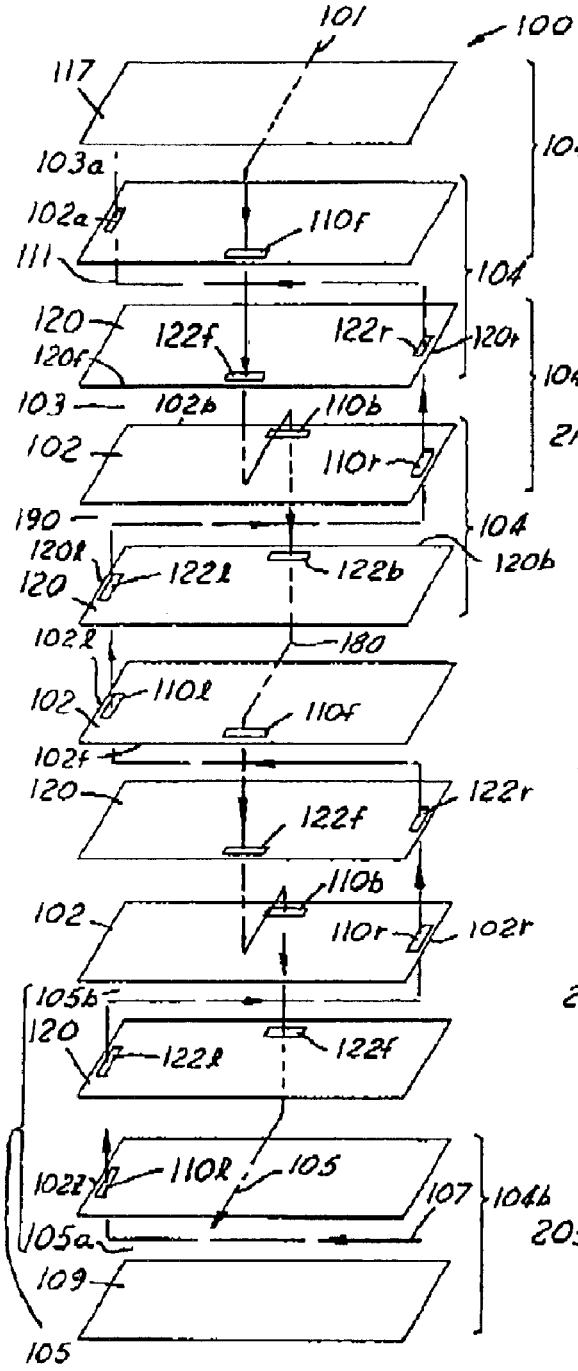
FIG. 3 illustrates the flow pattern of feed gas and burner exhaust utilizing serial cross flow through a plate frame reactor according to a preferred embodiment of the present invention.

FIG. 2A illustrates a header sheet 102 according to a preferred embodiment of the present invention having a central zone 106, a fin sheet 108, and a series of manifold ports 110. The central zone 106 houses the fin sheet 108 or roll-formed fins that form the extended heat transfer surface. The fin sheets 108 may contain louvres 111 or other features to control the flow across their surfaces as is known in the art. While the preferred embodiment depicts fin sheets 108, it is contemplated that other types of heat transfer surfaces, such as pin fins, metal foam, or corrugated sheets may beused as heat transfer components. The header sheet 102 may also contain a locator tab 114. While not depicted in FIG. 2A, the manifold ports 110 may be on any or all sides of the header sheet 102. As shown in FIG. 3 below, they will be depicted as 110*f* representing manifold ports located on the front side 102*f* of the header sheet 102, 110*l* for the ports located on the left side 102*l* of the header sheet, 110*r* for ports located on the right side 102*r* of the header sheet, and 110*b* for ports located on the back side 102*b* of the header sheet 102. Further, the number and size of manifold ports 110*f*, 110*r*, 110*l* and 110*b* may vary according to the flow strategy of the system that they are used in. In addition, these manifold ports 110 may be augmented by similar passages (not shown) for the conveyance of yet additional reactant fluids are diluents.

Figure 2B:
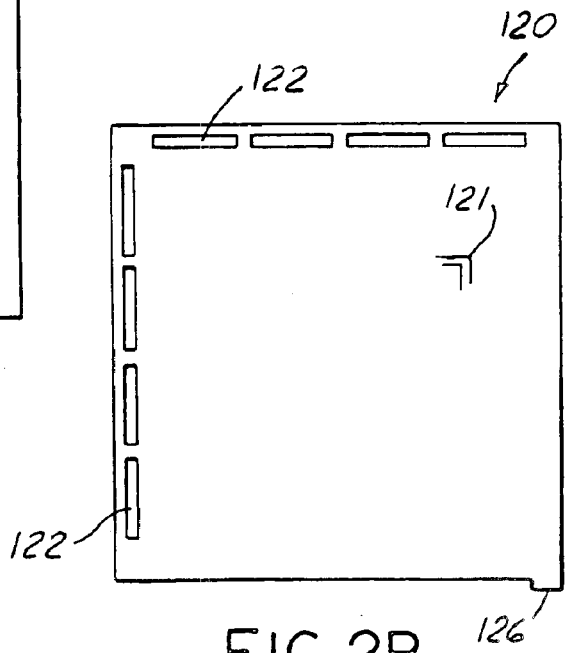
FIG. 2B is an interleaved sheet for use in a preferred embodiment of the present invention.

FIG. 2B illustrates the thinner interleaved sheet 120 according to a preferred embodiment of the present invention. The interleaved sheets 120 form the common heat transfer interface between the fluids. The interleaved sheet 120 may also contain a locator tab 126. Similar to the header sheets 102, the interleaved sheets 120 contain interleaved manifold ports 122. While not depicted in FIG. 2A, the interleaved manifold ports 122 may be located on any or all sides of the interleaved sheet 120. As shown in FIG. 3, the interleaved sheets 120 may have front side interleaved manifold ports 112*f*, right side interleaved manifold ports 122*r*, left side interleaved manifold ports 122*l*, and/or back side interleaved manifold ports 122*b*. Further, the number and size of the interleaved manifold ports 122*r*, 122*f*, 122*l*, and 122*b* may vary according to the flow strategy of the system they are placed in. Finally, the interleaved sheets may contain louvres 121 or other features to control the flow across their surfaces as is known in the art.

Figure 2C:
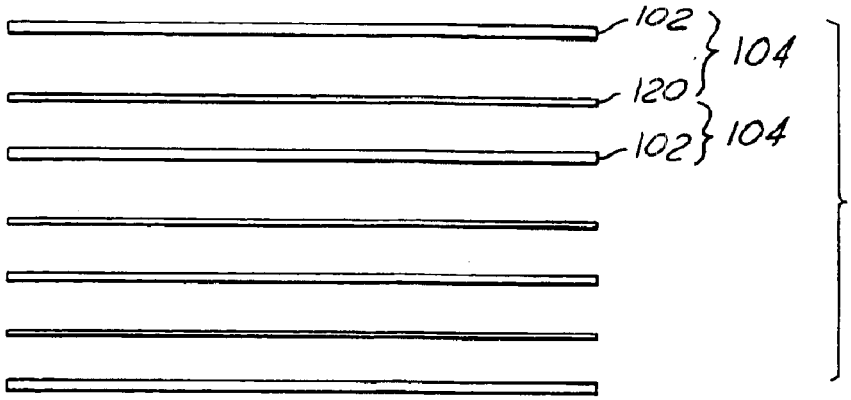
FIG. 2C is an exploded view illustrating the stacking of the cells according to a preferred embodiment of the present invention.
Figure 2D:
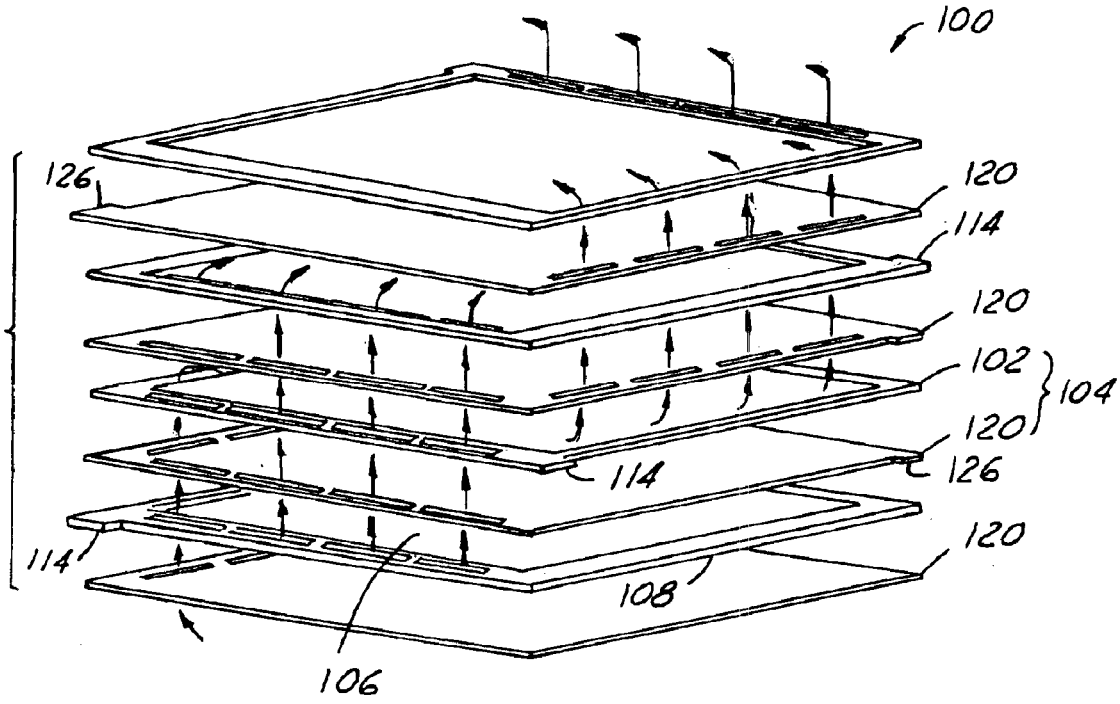
FIG. 2D is an exploded view illustrating the stacking of the cells, wherein the fin sheets have been added to the header sheets, according to a preferred embodiment of the present invention, wherein the fin sheets are placed into the header sheets.

FIGS. 2C and 2D illustrate an exploded view of alternating copies of the header sheet 102 and interleaved sheet 120 of FIGS. 2A and 2B. Each pair of header sheets 102 and interleaved sheets 120 form a single cell 104. The assembly of a purely serial flow heat exchanger 100 reactor from the bottom would proceed by rotating subsequent sets of header sheets 102 and interleaved sheets 120 90 degrees counterclockwise from the previous pair. For simplicity, note the location of the locator tab 114 of the header sheet 102 relative to the location of the locator tab 126 of the interleaved sheet 120 in a single cell 104. FIG. 2D illustrates the fin sheets 108 contained within the central zone 106 of the header sheet 102.

The header sheets 102 and interleaved sheets 120 may be joined through many techniques that are well known in the art, including soldering, brazing, and adhesive joining. For high temperature applications, brazing is the preferred method.

A catalyst material (not shown) may be affixed to the reactor 100 by applying a thin layer of catalytic material to the structural substrate material. This might comprise a layer of high surface area gamma-alumina powder with a dispersed catalytic metal adhered to a superalloy or stainless steel structure. The open manifolds 110, 122 possible in the serial flow design allow for uniform application of such "washcoat" catalyst layers because they allow uniform access to the complex fin sheets 108 upon which the bulk of the catalyst is disposed. Methods of applying such catalyst layers are well known in the art.

Referring now to FIG. 3, the flow patterns of feed gas and burner exhaust through the reformer 100 having purely serial flow geometry according to a preferred embodiment is depicted.

Cool feed gas enters the reformer 100 through an inlet port 101, or plenum. The feed gas then proceeds between a top sheet 117 and top header sheet 102*a* within a topmost cell 104*a* that defines a first reformer section 103*a*. The stop sheet 117, as depicted, is a sealing sheet and contains no manifold ports. However, the top sheet 117, in alternative embodiments, could contain the inlet port 101. The feed gas then enters front manifold port 110*f*, flows through the front interleaved manifold port 122*f* of the interleaved sheet 120. The feed gas then flows back through the next adjacent reformer section 103 to back manifold port 110*b*, flows through back manifold port 110*b* and back interleaved manifold port 122*b* and into the next adjacent reformer section 103. The feed gas then flows back through the next adjacent reformer section 103, enters the front manifold ports 110*f*, flows through front interleaved manifold 122*f*, and into the next adjacent reformer section 103. The process continues through the stack of reformer sections 103 until the heated and fully reacted feed gas reaches the outlet port 105. The number of cells 104 in the reformer 100 may vary greatly depending upon the requirements of the system. For example, flow rate, catalyst activity, and peak temperature are factors in determining the number of cells 104 within the reformer 100.

At the same time, heated burner exhaust enters the reformer 100 through a burner inlet port 107. The burner inlet port 107 is located at the bottomost cell 104*b*, while the feed gas inlet port 101 is located at the topmost cell 104*a*. Of course it is understood that the opposite could be true, wherein the feed gas inlet port 101 is located in the bottommost cell 104*b* and the burner inlet port 107 is located in the topmost cell 104*a*.

The burner exhaust flows through a first burner section 105*a* as defined between a bottom section 109 a bottom sheet 102*z*. The exhaust then enters the left manifold ports 110*l*, flows through left interleaved manifold ports 122*l*, and into the next adjacent burner section 105*b*. The exhaust then flow through the next adjacent burner section 105*b* and into the right manifold port 110*r*, through the right interleaved manifold port 122*r* and into the next adjacent burner section 105*b*. The process continues through the stack of burner sections 105*b* until the cooled exhaust gas reaches the burner outlet port 111.

As seen in FIG. 3, the flow patterns of the feed gas and the burner exhaust flow flowing through adjacent reformer sections 103 and burner sections 105 are locally perpendicular with respect to each other, although the overall flow geometry is counterflow. This is known as serial cross-flow geometry. In addition, heat is exchanged through the interleaved sheets 120. In this way, the feed gas is heated and eventually reacted and the burner exhaust gas is cooled within the reformer 100. To aid in the heat exchange, the interleaved sheets 120 may be provided with heat transfer enhancement in the form of louvres 121 or separate fin sheets 108.

In addition, a second inlet port 180 may be added to direct a secondary flow of feed gas into the reformer 100. The second inlet port 180 is added between one of the header sheets 102 and one of the interleaved sheets 120 defining a cell 104 and introduces feed gas to the reformer section 103. Similarly, a second burner inlet port 190 can be added to direct a secondary flow of burner exhaust gas, fuel, oxidant, or diluent into the burner section 105. In this way, the heat exchange, and corresponding chemical reaction in the reformer section 103 and burner section 105, can be more closely controlled in order to avoid hot spots and limit unwanted chemical reactions. Of course, the number of second inlet ports 180 and second burner inlet ports 190 may be increased beyond the two depicted in FIG. 3 depending upon the requirements of the system.

Figure 4:
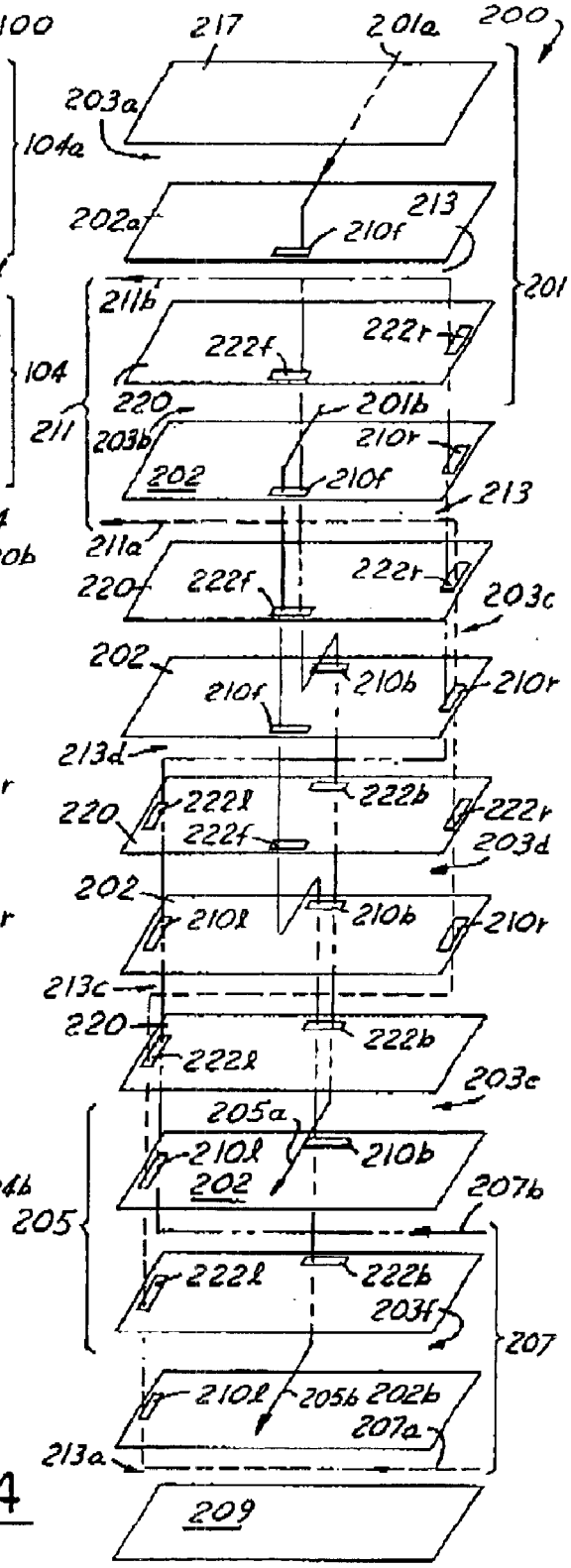
FIG. 4 illustrates the flow pattern of feed gas and burner exhaust utilizing purely serial cross flow through a plate frame reactor according to another preferred embodiment of the present invention; and, FIG. 5 illustrates the flow pattern of feed gas and burner exhaust utilizing a combination of serial cross flow and parallel flow through a plate frame reactor according to another preferred embodiment of the present invention.

In another preferred embodiment of the present invention, as depicted in FIG. 4, a reformer 200 is illustrated having serial parallel flow with two cells in parallel. The locally perpendicular flow of feed gas and exhaust gas flows similarly to the reformer 100 of FIG. 3, but instead of every other cell having reformer sections and burner sections with different flow directions and temperature distributions, the cells are paired in groups of two, each having substantially identical flow directions and temperature distributions.

Cool feed gas enters the top of the reformer 200 at a pair of inlet ports 201*a*, 201*b* defining inlet port 201. The feed gas entering through inlet port 201*a* flows between a top sheet 217 and a first header sheet 202*a* which defines a first reformer section 203*a*. Feed gas flows through the first reformer section 203*a* and into the front manifold ports 210*f*, through a front interleaved manifold port 222*f* of a adjacent interleaved sheet 220, through a front manifold ports 210*f* of the next adjacent header sheet 202, and through a front interleaved manifold port 222*f* of the next interleaved sheet 220 and into a reformer section 203. The feed gas then flows through the reformer section 203*c* and into a rear manifold part 210*b*, through a rear interleaved manifold port 222*b*, through another rear manifold port 210*b*, and through another rear interleaved manifold port 222*b* to reach the next reformer section 203*e*. The process continues based on the flow requirements of the system until it reaches a feed gas outlet port 205*a*.

At the same time, a second quantity of cool feed gas flows from inlet port 201*b* between the first header sheet 202*a* and the first interleaved sheet 220*a* that defines a second reformer section 203*b*. The second quantity of cool feed gas then flows through a front interleaved manifold port 222*f* of the first interleaved sheet 220*a*, through a front manifold ports 210*f* of the next adjacent header sheet 202, through a front interleaved manifold port 222*f* of the next adjacent interleaved sheet 220, and through a front manifold port 210*f* and into a reformer section 203*d*. The feed gas flows through reformer section 203*d*, through a rear manifold port 210*b*, through a rear interleaved manifold port 222*b*, through a rear manifold port 210*b* or the next adjacent interleaved sheet 202, through a rear interleaved manifold port 222*b* of the next adjacent interleaved manifold sheet 220, and into the next adjacent reformer section 203*f*. Depending upon the flow requirements of the system, the first and second quantity of feed gas may intermingle between the reformer sections 203*a*, 203*b* respectively by being injected into the same manifold ports 210 or interleaved manifold ports 220. Similarly, the feed gas could intermingle between reformer sections 203*d* and 203*e*, respectively, and every next adjacent pair thereafter. The flow process continues until the feed gas reaches feed gas outlet port 205*b*. Feed gas outlet port 205*a* and 205*b* define feed gas outlet 205, which discharges heated reformed feed gas from the reformer 200.

At the same time cool feed gas is introduced through feed gas inlet port 201, heated burner gas is being introduced to the reformer 200 at burner gas inlet port 207. A first quantity of heated burner exhaust gas or partially or fully unreacted fuel and oxidant enters burner inlet port 207*a* between bottom sheet 209 and header sheet 202*b*, which defines a first burner section 213*a*. The heated burner gas flows across burner section 213*a* and enters left manifold port 210*l*, goes through left interleaved manifold port 222*l*, through left manifold port 210*l* of an adjacent header sheet 202, and through a left interleaved manifold port 222*l* of the adjacent interleaved sheet 220 and into the next burner section 213*c*. The burner gas then flows across the burner section 213*c* and enters right manifold port 210*r*, through right interleaved manifold port 222*r*, through right manifold port 210*r*, and through right interleaved manifold port 222*r* and into the next adjacent burner section 213*f*. This process continues until the burner gas reaches outlet port 211*a*.

At the same time, a second quantity of heated burner gas enters burner inlet port 207*b* and into burner section 213*b* defined by header sheet 202*b* and interleaved sheet 220. The burner gas proceeds through burner section 213*b* and enters the left interleaved manifold port 220*l*, through left manifold port 210*l*, through left interleaved manifold port 220*l* of the next adjacent interleaved sheet 220, and through left manifold port 2101 of the next adjacent header sheet 202 and into the next adjacent burner section 213*d*. The burner exhaust flows through the burner section 213*d* and into the right interleaved manifold port 222*r*, the right manifold port 210*r*, the next right interleaved manifold port 222*r*, and the next manifold port 210*r* and into the next burner section 213*f*. The process continues until the second quantity of burner gas reaches burner outlet port 211*b*. Outlet ports 211*a* and 211*b* form burner outlet port 211, which discharges cooled burner exhaust from the reformer 200.

It is contemplated that the first quantity of burner gas and the second quantity of burner gas may intermingle between burner sections 213*a*, 213*b* by using the same manifold ports 210, 222 located along the various sides of the header sheets 202 and interleaved sheets 220. Similarly, the reformer gas could intermingle between reformer sections 203*d* and 203*e*, respectively, and every next adjacent pair thereafter.

Further, it is contemplated in another preferred embodiment not depicted here that the serial cross-flow geometry could vary between 3, or even 4 sets of sheets or more depending upon the flow characteristics desired within the reformer, thereby reducing the peak Reynold's number. In addition, it is contemplated that the reformer could use a combination of embodiments as depicted in FIGS. 3 and 4, wherein the zones used within the reformer are varied between single zones of cross flow, as in FIG. 3, and paired zones, as in FIG. 4. Again, the specific combination of these zones would depend upon the desired characteristics of the system.

Figure 5:
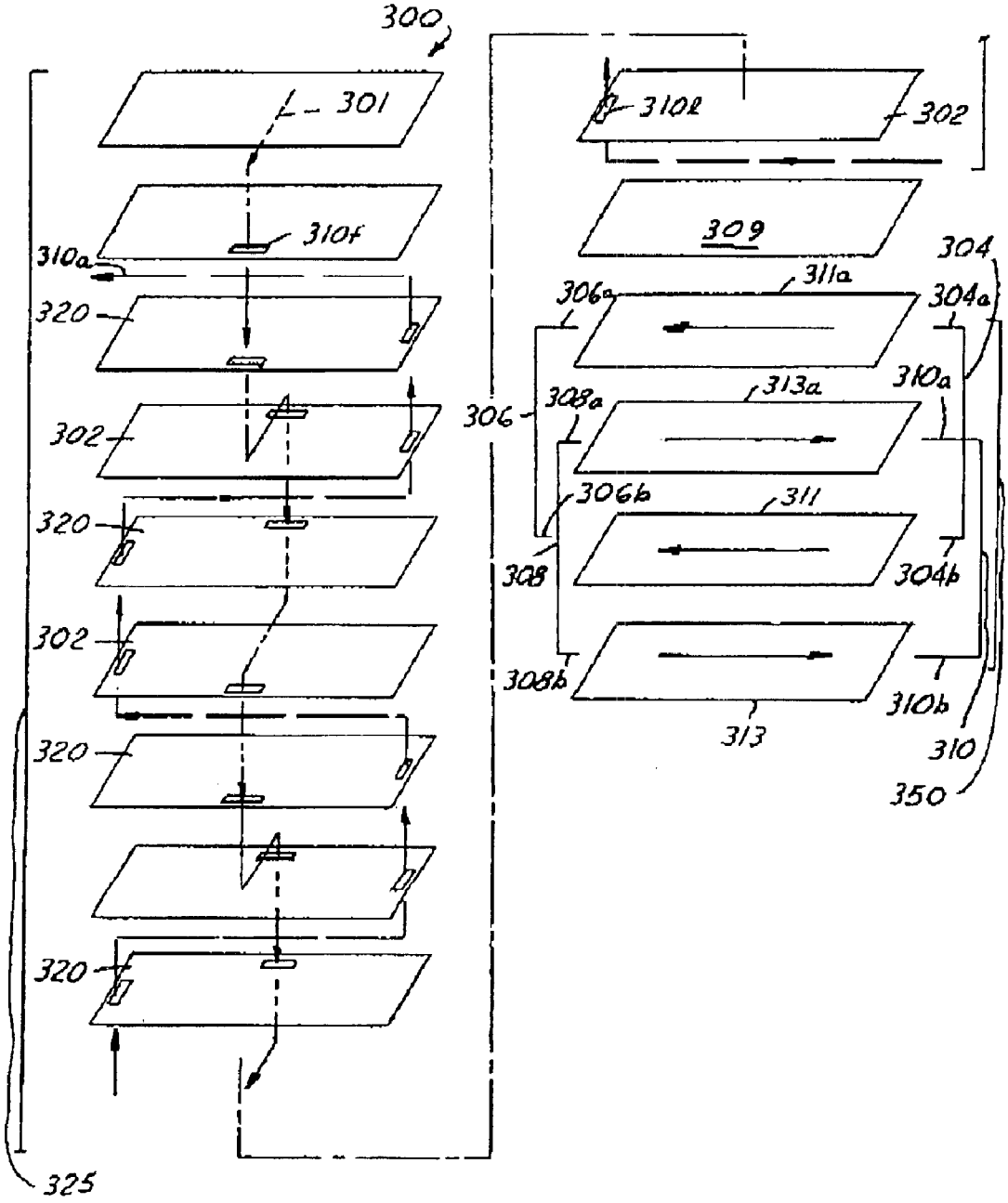

Referring now to FIG. 5, another embodiment of the present invention is depicted. In this embodiment, a reformer 300 is depicted having a mixture of serial flow zone reformers 325 and parallel flow zone reformers 350. The serial flow zone reformers 325, for example, may be similar to reformer 100 from FIG. 3 or reformer 200 form FIG. 4, and is depicted similar to reformer 100 for representative purposes in FIG. 5. In the parallel-flow zone reformer 350 portion, a feed gas inlet port 304*a* and a feed-gas outlet port 306*a* are introduced at opposite ends between the bottom sheet 309 of the serial cross-flow reformer 325 and a first header sheet 311 of parallel-flow reformer 350. A burner gas inlet port 308*a* and burner gas outlet port 310*a* is introduced between the first header sheet 311*a* and an interleaved sheet 313*a*. Another feed gas inlet port 304*b* and feed gas outlet port 306*b* may be introduced between interleaved sheet 313*a* and the next adjacent header sheet 311*a,* while another burner gas inlet port 308*b* and burner gas outlet port 310*b* may be introduced between header sheet 311 and the interleaved sheet 313. In this way, a reformer 300 can have mixtures of serial cross-flow and parallel-cross flow.

The exact mix of serial 325 and parallel zones 350 within reformer 300 would depend upon optimization based upon the system being investigated. Systems where exchanger mass, volume, and cost predominate would tend to have a more highly serial architecture.

Plate-frame heat exchange reactors with serial cross-flow geometry according to the present invention offers many advantages over traditional massively parallel units.

First, the present invention allows for tailoring the Reynold's number of the flow to greatly improve the heat transfer and/or mass transfer characteristics of the reactor. This allows reactor size to be reduced by half or more, resulting in substantial savings in weight, volume, and cost.

Second, the present invention allows for the possibility of introducing reactants at many distributed points, rather than only at the entry point in massively parallel designs, using a simple mechanical feature added to the header sheets. This controls the formation of hot spots within the reactor that could lead to undesirable chemical reactions.

Third, the present invention offers greatly simplified manifolding of the flows and reduces the number of distinct components required for the heat exchanger. This results in substantial cost savings as compared with massively parallel designs.

Fourth, the heat exchanger plates are not constrained by a desire to create a high aspect ratio, perfect counterflow ratio in a single cell.

The application of the present invention is ideally suited for reaction systems where current, massively parallel plate frame reactors are inadequate. One example is stream reforming of hydrocarbons or alcohols where reactor size is principally determined by heat transfer, and where controlled release of oxidant can greatly reduce the risk of hot spot formation. Another example is the preferential oxidation of carbon monoxide where close control of temperature, controlled oxidant release, and improved mass transfer are desired.

While the invention has been described in terms of preferred embodiments, it will be understood, of course, that the invention is not limited thereto since modifications may be made by those skilled in the art, particularly in light of the foregoing teachings.

What is claimed is:

1. A plate frame heat exchange reactor assembly comprising:

a plurality of header sheets, each of said plurality of header sheets having a plurality of manifold ports;

a heat transfer surface contained within a central region of each of said plurality of header sheets;

a plurality of interleaved sheets, wherein one of said plurality of interleaved sheets being located between each adjacent pair of said plurality of header sheets, each of said plurality of interleaved sheets having a plurality of interleaved manifold ports;

wherein one of said plurality of interleaved sheets and an adjacent one of said plurality of header sheets defines a cell;

a feed gas inlet manifold port for directing a feed gas into the assembly;

a burner feed inlet manifold port for directing a burner exhaust gas into the assembly;

a reformer section coupled to said feed gas inlet manifold port so as to receive a stream of feed gas from said feed gas inlet manifold, said reformer section converting said stream of feed gas to a stream of reformed stream gas, said reformer section having a plurality of reformer channels, each of said reformer channels being formed between every other of said cells;

wherein at least two of said plurality of reformer channels are coupled together to form a coupled reformer channel, wherein each of said coupled reformer channels is coupled to the next adjacent one of said coupled reformer channels through at least one of said plurality of manifold ports and at least one of said plurality of interleaved manifold ports;

a burner gas section coupled to the burner feed inlet manifold so as to receive heated burner exhaust, gas said burner gas section having a plurality of burner channels, each of said burner channels being formed between the other of every other of said cells;

wherein at least two of said plurality of burner channels are coupled together to form a coupled burner channel, wherein each of said coupled burner channels is coupled to the next adjacent one of said coupled burner channels through at least one of said plurality of manifold ports and at least one of said plurality of interleaved manifold ports;

an outlet manifold coupled to said reformer section for removing reformed feed gas from the assembly;

a burner outlet manifold coupled to said burner section for removing cooled burner exhaust gas from the assembly;

wherein said feed gas flow in said coupled reformer channel and said burner exhaust gas flow in said next adjacent coupled burner channel are substantially perpendicular with respect to one another;

wherein said feed gas flow in said coupled reformer channel and said feed gas flow in a next adjacent one of said coupled reformer channels flow in opposite directions with respect to one another;

wherein said burner exhaust gas flow in said coupled burner channel and said burner exhaust gas flow in a next adjacent of said coupled burner channels flow in opposite directions with respect to one another; and wherein said feed gas flow and said burner exhaust gas flow are substantially cross-flow with respect to one another in said reformer section and said burner section.

2. The assembly of claim 1, further comprising a second inlet manifold port coupled to one of said reformer channels between one of said plurality of header sheets and one of said plurality of interleaved sheets.

3. The assembly of claim 1, wherein a thin layer of catalyst is coated on each of said heat transfer surfaces and on each of said plurality of interleaved sheets.

4. The assembly of claim 3, wherein said thin layer of catalyst comprises a layer of γ-alumina powder with a dispersed catalytic metal.

5. The assembly of claim 1, wherein each of said header sheets are brazed to each of said adjacent interleaved sheets.

6. The assembly of claim 1 further comprising at least one parallel zone interspersed within the assembly, said at least one parallel zone comprising:

at least one second reformer section coupled to a third inlet manifold port so as to receive a third stream of feed gas from said feed gas inlet manifold port, wherein said at least one second reformer section converting said third stream of feed gas to a third stream of reformed stream gas, each of said at least one second reformer section having a second reformer channel, each of said second reformer channels being formed between one of a plurality of second header sheets and an adjacent one of said plurality of second interleaved sheets, wherein said second reformer channel is connected to said outlet manifold;

at least one second burner gas section coupled to said burner feed inlet manifold so as to receive a second stream of burner exhaust gas, each of said at least one second burner gas sections having a second burner channel formed between one of said plurality of second header sheets and the other adjacent one of said plurality of second interleaved sheets, wherein each of said second burner channels is coupled to said burner outlet manifold; and wherein the flow of said third stream of feed gas and the flow of said second stream of burner exhaust gas through said at least one parallel zone are substantially parallel and either in a co-flow or counterflow configuration with respect to one another.

* * * * *